United States Patent [19]

Brünsicke

[11] Patent Number: 4,531,588

[45] Date of Patent: Jul. 30, 1985

[54] FIRE SUPPRESSION SYSTEM

[75] Inventor: Wilhelm A. Brünsicke, Santa Monica, Calif.

[73] Assignee: Lockheed Corporation, Burbank, Calif.

[21] Appl. No.: 577,639

[22] Filed: Feb. 6, 1984

[51] Int. Cl.[3] ..... A62C 1/20

[52] U.S. Cl. ..... 169/9; 169/15; 169/19; 169/20; 169/85

[58] Field of Search ..... 169/9, 14, 15, 19, 20, 169/22, 60, 61, 85

[56] References Cited

U.S. PATENT DOCUMENTS

| | | | |
|---|---|---|---|
| 2,819,764 | 1/1958 | Anthony, Jr. | 169/85 |
| 4,390,069 | 6/1983 | Rose, Jr. | 169/15 |

FOREIGN PATENT DOCUMENTS

| | | | |
|---|---|---|---|
| 2825703 | 12/1979 | Fed. Rep. of Germany | 169/14 |
| 2294721 | 8/1976 | France | 169/14 |

*Primary Examiner*—Andres Kashnikow
*Assistant Examiner*—Mary Beth O. Jones
*Attorney, Agent, or Firm*—Louis L. Dachs

[57] ABSTRACT

The invention is a fire suppression system. A first dispensing assembly 22 is adapted to provide a flow of liquid fire suppression chemical at a constant pressure to a first outlet port 24. A first valve assembly 26 is coupled to the first outlet port 24 and is adapted to control the flow of the liquid chemical as a function of the temperature thereof to a second outlet port 34. A second valve assembly 32 is coupled to the second outlet port 34 of the first valve assembly 26 and is adapted to meter the liquid chemical as a function of the inlet pressure level and selected flowrates and to cause the liquid chemical to partially vaporize, forming a liquid/vapor phase, first mixture. A second dispensing means 44 is provided which is adapted to deliver a second mixture composed of water and foaming agent at a constant pressure. A nozzle assembly is coupled to (1) the second dispensing assembly 44, via line 46, (2) to a third outlet port 38 of the second valve assembly 32 and, additionally, (3) to a source of ambient air. The nozzle assembly 42 is adapted to fully vaporize the first mixture and to expand the vaporized chemical to ambient pressure. Thereafter, the nozzle assembly 42 combines the ambient air and the vaporized chemical at ambient pressure forming a third mixture and to further combine the third mixture with the second mixture by encapsulation, forming a foam wherein the bubbles of the foam contain the third mixture.

12 Claims, 15 Drawing Figures

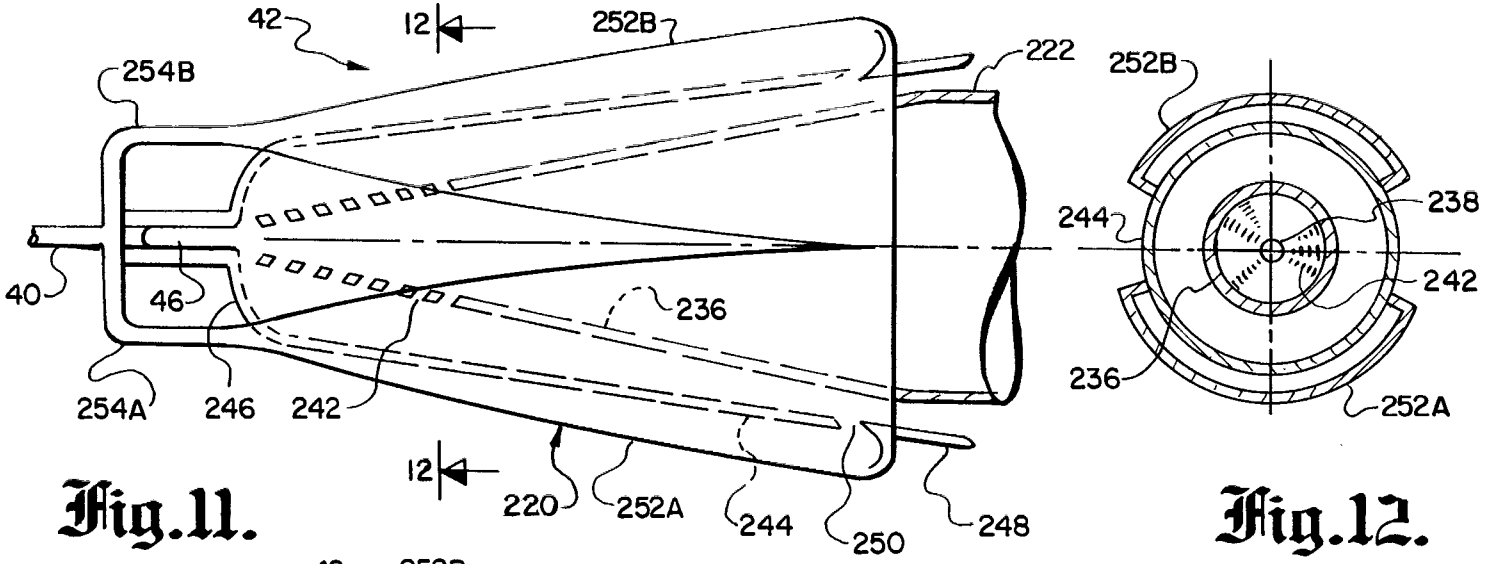
Fig. 12.
Fig. 11.
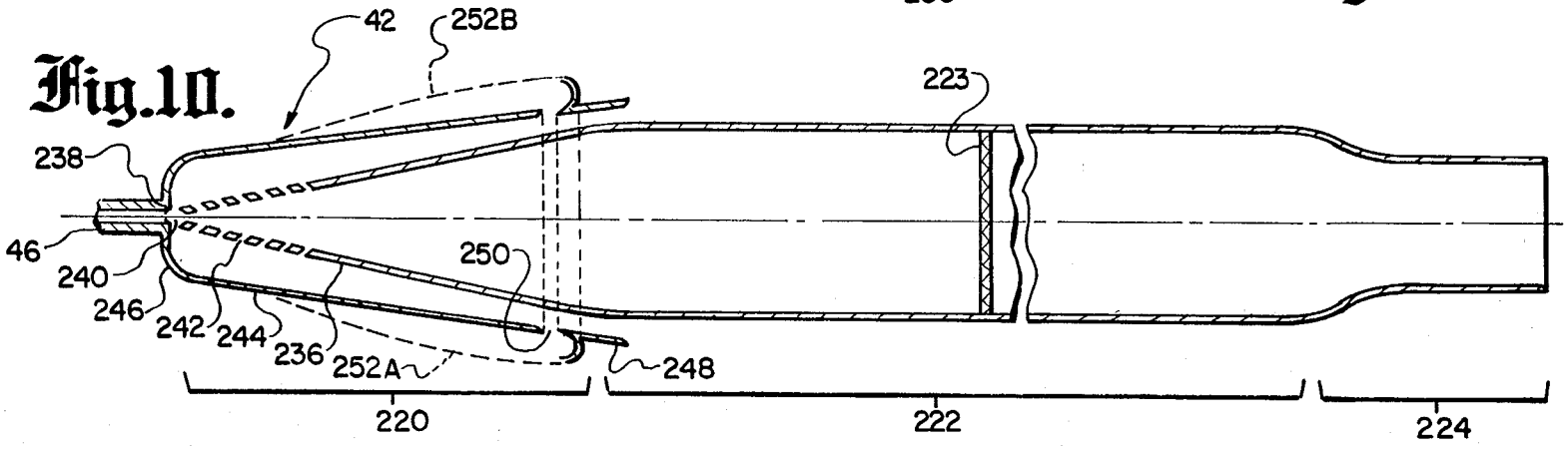
Fig. 10.

FIRE SUPPRESSION SYSTEM

TECHNICAL FIELD

The invention relates to the field of fire-fighting equipment and, in particular, to a fire suppression system which is also suitable for use in confined areas containing people.

BACKGROUND ART

A great many methods and substances exist to fight fires. When dealing with fires aboard aircraft, buses, trains, etc., large amounts of water are generally not available and portable containers of fire suppressants are carried. These usually consist of $CO_2$ pressurized, dry chemicals or Halon compounds which vary in effectiveness depending upon the type of fire. For example, dry chemicals are very effective against fires where the ignition source is electrical, while the use of water may cause more problems than it solves because of the possibility of additional electrical shorts.

The instant invention is primarily concerned with extinguishers using the combination of water/foaming agents and Halon compounds, since water/foaming agents are much more effective than plain water and Halon compounds are very effective fire suppressants. For example, Halon compounds are used as a primary fire suppressant in aircraft jet engine nacelles and cargo compartments. Unfortunately, in excessive concentrations, they are poisonous to human beings. Thus, in confined areas, such as in aircraft passenger compartments, the trick is to accurately meter the Halon compounds to ensure that the Halon is thoroughly mixed with the foam to permit effective fire control while at the same time keeping the toxicity level within limits.

Initially, it will be useful to review some of the more pertinent water/foaming agents and inert gas/foaming agent extinguishers. In the latter case, German Pat. No. DE 2747588, Fire Extinguisher, by B. Gerhard is of interest. When manually activated, released nitrogen gas forces the foaming agent out of a tank to a discharge nozzle. Simultaneously, a spike, driven by nitrogen gas pressure penetrates a $CO_2$ cartridge, releasing the gas therein. The internal mixing of the nitrogen, $CO_2$ gas, and the foaming agent results in what is believed to be a foam of improved fire suppressing capacity. One of the problems with such a system is that the spike which penetrates the $CO_2$ cartridge remains in place and thereby obstructs the $CO_2$ outflow area. Also, it is not readily apparent why the combination of inert gases is any better than a single inert gas.

Another patent of interest is U.S. Pat. No. 4,106,566, Process for the Utilization of Low and Medium Expanded Foam for the Extinction of Fires from Liquefied Products, by G. Dion-Biro. Here, a medium foam expansion generator is coupled to three low expansion foam generators such that the discharge flow of the low-ratio generators will interact with the medium generator discharge flow at some distance downstream of their discharge nozzles. At this point, the medium-ratio foam is to be drawn by the low-ratio foam into an extended throw-range profile. Furthermore, the high water content of the low-ratio foam is to be compensated for by the low water content of the medium-ratio foam.

This concept raises technical questions relative to the dynamic interaction of flow streams of significantly different density, velocity, and kinetic energy. It appears likely that a sizeable portion of the relatively fragile medium-ratio foam will be destroyed in this process.

Of further interest is U.S. Pat. No. 3,979,326, Dry Foam Producing Apparatus, by J. Chatterton which is intended to produce large quantities of what is identified as "dry foam". This is to be accomplished by use of an autoclave-like pressure vessel supplied with compressed air and a detergent/water solution by auxiliary subsystems. A quantity of the detergent/water solution is provided in the basin portion of the vessel. Located above the basin are two perforated conical plates which are joined to the inner surface of the vessel such that their apex is pointed downward toward the basin. The apex of the plates and the basin are connected by a drain tube. By injecting compressed air into the detergent-/water solution, a large foam flow is generated. This foam, due to its volumetric expansion, is forced through the perforated conical plates where a significant quantity of liquid is removed from each foam bubble. The "removed" liquid is returned to the basin. After this process, the foam passes through an exit aperture where, through filtering, more moisture is extracted. Furthermore, chemicals may be applied to the external surfaces of each bubble. Following this process, the so-called "dry foam" is ready for application.

This process causes destruction of the large bubbles by forcing them through the small holes in the plates. The perforated cones are a significant flow area reduction with a corresponding pressure drop. Actually, the destruction of the large bubble results in liberation of the foaming fluid, a part of which is converted into small bubbles while the remainder drains back to the basin.

The above three patents are of interests in that they disclose state-of-the-art methods for generating foam-type fire suppressant. None, of course, deal with the use of a third fire suppressant chemical such as Halon.

There are numerous systems making use of Halon compounds. As previously mentioned, pure pressurized Halon is ideally suitable for use in jet engine nacelles and the like where there obviously are no people present. Although not entirely clear, it is believed that the Halon interfers directly with the combustion process making it ideally suited in such applications. An example of the use of Halon compounds in fire extinguishers can be found in U.S. Pat. No. 4,069,872, Method of and Device for Extinguishing Burning Gases, by H. Lassen. This device is intended to suppress a fire in the bleed-off vent of a low temperature liquid gas tank. To this end, a coaxial cone arrangement, of which the lower part forms a divergent area and the outer upper section forms a convergent area, is utilized. The cone assembly also contains Halon discharge nozzles and provisions for supplemental combustion air. In the event of a fire, the Halon is discharged between the vent exit and the combustion area. Here, as in the case of the jet engine nacelle, there are no people present and, thus, very little control over the amount of Halon released is necessary. In fact, in such a situation, the more, the better.

Also of interest is U.S. Pat. No. 4,390,069, Trifluorobromomethane Foam Fire Fighting System by G. R. Rose, Jr. In this device, it is intended that the fire suppressant characteristics of a low expansion ratio water/-foaming agent solution be improved by the use of a Halon compound. This is achieved by the injection of Halon 1301 in its liquid phase into a low expansion ratio foam water/agent solution which is utilized in a low expansion ratio foam generator. The Halon storing and supply system consists of a pressure vessel wherein the Halon is retained at its saturated vapor pressure in its liquid phase. Furthermore, a shut-off valve, check valve, and associated tubing are provided through which the Halon is conveyed to the point of injection. Liquid phase Halon is injected into: (1) a flowing confined stream of low expansion ratio foam solution, (2) into a low expansion ratio foam solution proportioning and pressurization pump, and (3) into the air induction ports of a low expansion ratio foam generator. All of these foam generators are intended to utilize solutions containing 1.5 to 6% of foaming agents. They are limited to a maximum expansion ratio of 1 to 15.

There are some technical questions raised by such a system. The saturated vapor pressure of Halon 1301 at 70° F. is 200 psig. This is the expulsion force in the illustrated system. (It actually is 214 psig at the quoted temperature.) What is not disclosed is that this pressure varies significantly as a function of temperature. For instance, at 30° F. the pressure is 103.9 psig and at 100° F. it is 300.6 psig.

In addition to significant pressure variations, the viscosity of the liquid also changes. For instance, the viscosity of liquid Halon at 30° F. is 0.240 centipoise, at 100° F. the viscosity is 0.141 centipoise. A proportional change in the fluid density also occurs as a function of temperature and pressure.

These variations of saturated vapor pressure, viscosity, and density of liquid Halon 1301 are irrelevant if the Halon is utilized in a supercharged high rate discharge system in which the total content of the pressure vessel is expelled in a fraction of a second. The same applies to nonsupercharged, small, hand-held fire extinguishers which are utilized for point protection. However, in a system where a finite quantity of Halon is to be metered over an extended time period, these variations become critical. In fact, without controlled compensation for variations of temperature and pressure, it is impossible to meter a finite quantity of Halon 1301 in its liquid state. Therefore, the Halon concentration level is not effectively controlled by fixed geometry metering orifices.

The assumption that Halon 1301, when injected in its liquid phase into a flowing pressurized confined stream of low expansion ratio foam solution, will, upon discharge of the solution, result in foam bubbles which are stable, is questionable for the following reasons:

1. On high capacity, low expansion ratio foam generators, the discharge nozzle pressures are high (above 100 psig). This means that any expansion of liquid-phase Halon within the pressurized flowing stream of foam solution is limited by the stream pressure. Consequently, the vaporization (expansion) of the Halon will occur abruptly when the stream leaves the discharge nozzle.

2. Since the type of foaming agent which is used with the above identified foam generator is limited to a maximum expansion ratio of approximately 1 to 15 (one of the limits is the membrane strength of the bubbles), full expansion of the Halon to prevailing ambient pressure, most likely, will result in rupture of the membrane and, consequently, a loss of Halon.

3. If Halon 1301 (although not water soluble) is injected into water in its liquid phase, hydrate formation (solid crystals) may occur under certain pressures and temperature conditions. While not mentioned in the patent, medium-to-high expansion ratio generators (50–1000 to 1), which are significantly different from low expansion ratio foam generating devices, cannot process liquid-phase Halon in the encapsulation sequence.

In conclusion, the system does not maintain the Halon storage vessel at constant pressure, does not provide compensation for variations in liquid temperature or viscosity changes, does not compensate for transfer line losses, nor does it provide for the total expansion of the Halon compound to prevailing ambient pressure levels. Of most importance, it can not control the Halon concentration level in the bubbles to a level of 5% or lower. Finally, it can not, if required by the fire characteristics, increase the Halon concentration level in the bubbles up to 15% for rapid fire knock down.

Other patents of interest are U.S. Pat. No. 2,819,764, Fire Extinguishing Apparatus, by C. Anthony, Jr., U.S. Pat. No. 3,384,182, Method and Apparatus for Extinguishing Fires Utilizing a Single Aqueous Solution of a Salt and a Foaming Agent, by G. Rotvand, U.S. Pat. No. 3,804,759, Aerosol Fire Extinguisher and Method, by J. R. Becker et al., U.S. Pat. No. 3,998,274, Fire Extinguisher Head Assembly, by J. P. Liautaud, U.S. Pat. No. 4,088,194, Combination Gauge Shield and Lock Pin for a Fire Extinguisher, by H. D. Hard, and U.S. Pat. No. 4,164,960, Apparatus for Mixing Fluids, by C. W. Howard.

Therefore, it is a primary object of the subject invention to provide a fire suppression system using water/-foaming agent-Halon compounds.

A further object of the subject invention is to provide a fire suppression system that is capable of actually adjusting the amount of Halon that is delivered to the fire by the water/foaming agent-Halon mixture.

It is still another object of the subject invention to provide a fire extinguisher system that utilizes hermetically sealed containers for the Halon and the inert pressurizing gas which can be used to provide a constant expulsion force for the Halon.

DISCLOSURE OF INVENTION

The invention is a fire suppression system. A first dispensing means is adapted to provide a flow of liquid fire suppression chemical, preferably Halon, at a constant pressure to a first outlet port. In detail, the first dispensing means comprises a first tank having an outlet port, the first tank is adapted to contain an inert pressurized gas, preferably nitrogen. A second tank is adapted to contain the Halon, the second tank incorporating a first outlet port and, additionally, an inlet port. Passage means coupling the first tank to the second tank is provided. A regulator means is mounted in the passage means and is adapted to control the pressure level in the second tank to a constant value. A valve is provided which is adapted, when actuated, to direct pressurized inert gas from the first tank to the second tank via the passage means.

A first valve means is coupled to the first outlet port and is adapted to control the flow of the liquid Halon, as a function of the temperature thereof, to a second outlet port mounted thereon. This first valve means can be either manual or automatic.

A second valve means is coupled to the second outlet port of the first valve means and is adapted to meter the liquid Halon as the function of the inlet pressure level of the chemical and to cause the liquid chemical to partially vaporize, forming a liquid/vapor phase first mixture, and deliver the first mixture to a third outlet port. This second valve means can also be either manually operated or automatic.

A second dispensing means is provided which is adapted to deliver a second mixture composed of water and foaming agent at a constant pressure. The second dispensing means comprises a third tank adapted to be filled with water and a fourth tank adapted to be filled with a foaming agent. A proportioning pump means is provided which is coupled to the third and fourth tanks and provides the second mixture of water and foaming agent in a precise volume ratio to the nozzle. A shut-off valve is coupled to the proportioning pump which is adapted to control the flow of the second mixture to a nozzle means.

The nozzle means is coupled to the second dispensing means and a third outlet port of the second valve means and, additionally, to a source of ambient air. The nozzle means is adapted to fully vaporize the first mixture and to expand the vaporized Halon to ambient pressure. Thereafter, the nozzle combines the ambient air and vaporized Halon at ambient pressure forming a third mixture and to further combine the third mixture with the second mixture, forming a foam wherein the bubbles of the foam contain the third mixture. The nozzle means exists in two configurations, the first making use of venturi effects to mix the vaporized Halon/air and foam, and a second which uses a powered fan.

The novel features which are believed to be characteristic to the invention, both as to its organization and method of operation, together with further objects and advantages thereof, will be better understood from the following description connected with the accompanying drawings in which presently prefered embodiments of the invention are illustrated by way of examples. It is to be expressly understood, however, that the drawings are for purposes of illustration and description only and are not intended as a definition of the limits of the invention.

BRIEF DESCRIPTION OF DRAWINGS

Illustrated in FIG. 1 is a schematic representation of the fire suppression system.

Illustrated in FIG. 2 is a side-elevation view of a mechanically operated ram assembly adapted to puncture a diaphragm sealing off the inert gas tank.

Figure 3:
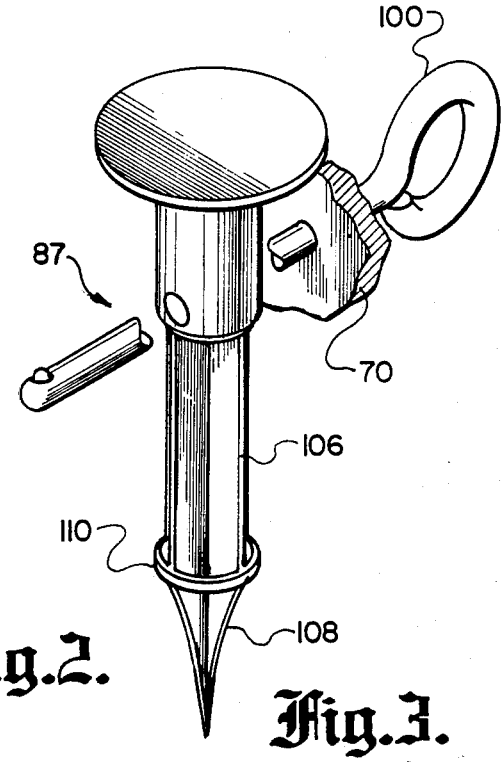

Illustrated in FIG. 3 is a side-elevation view of the ram used to punture the diaphragms on the second (Halon) storage tank.

Figure 4:
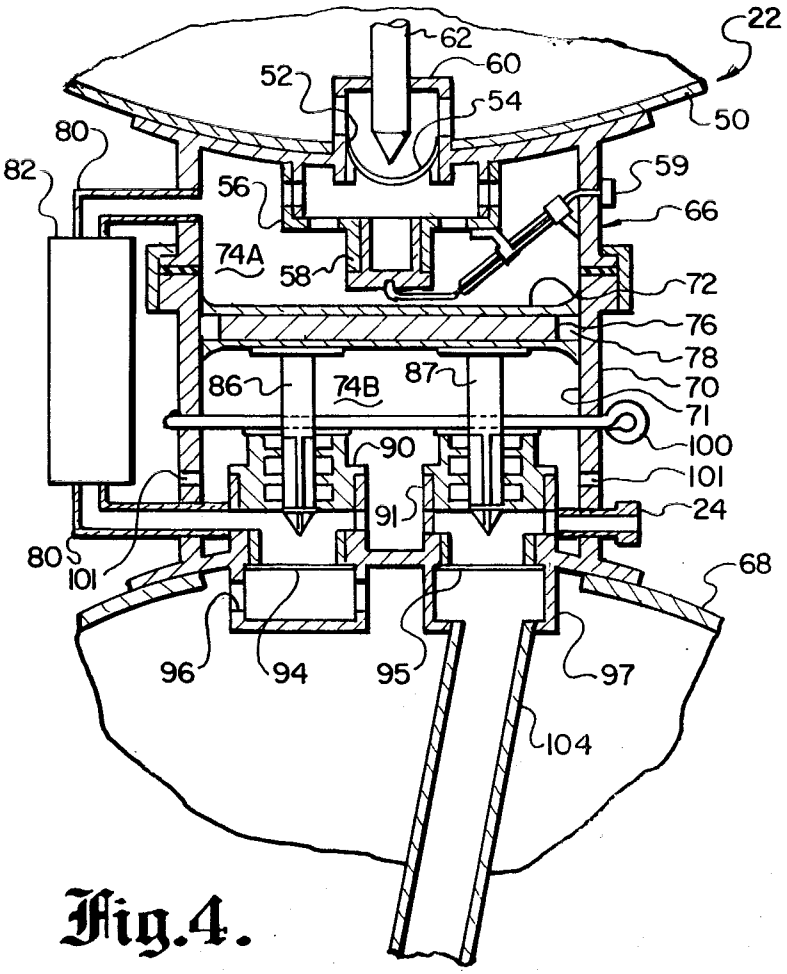

Illustrated in FIG. 4 is a partial cross-sectional view of the first dispensing means in the inactivated position, which is adapted to deliver a flow of liquid Halon.

Figure 5:
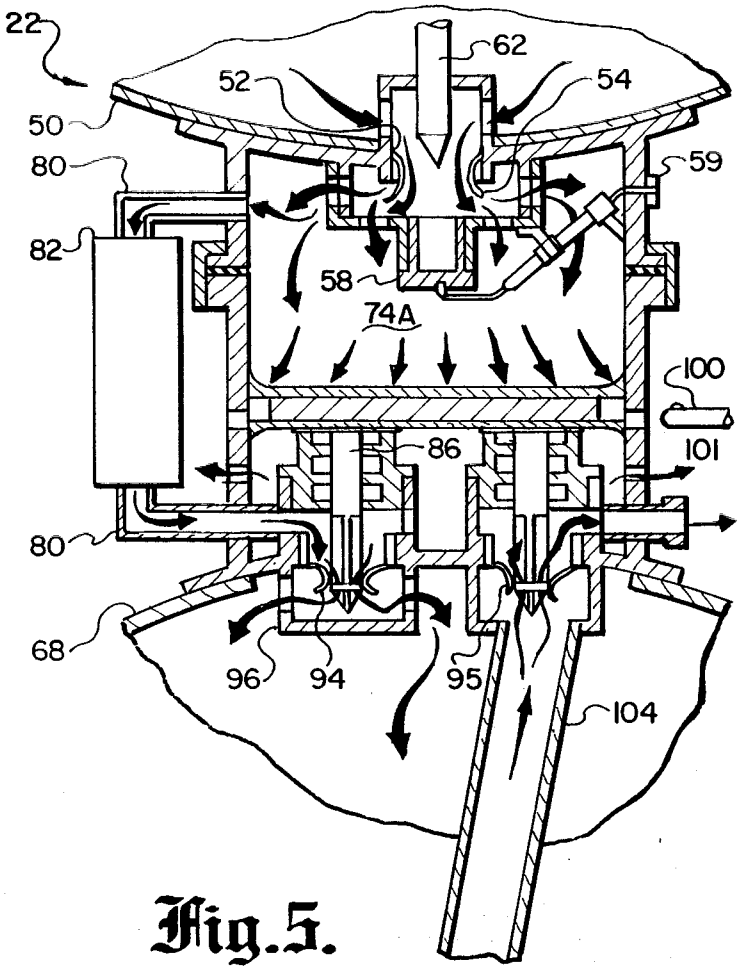

Illustrated in FIG. 5 is a partial cross-sectional view of the first dispensing means in the activated position.

Figure 6:
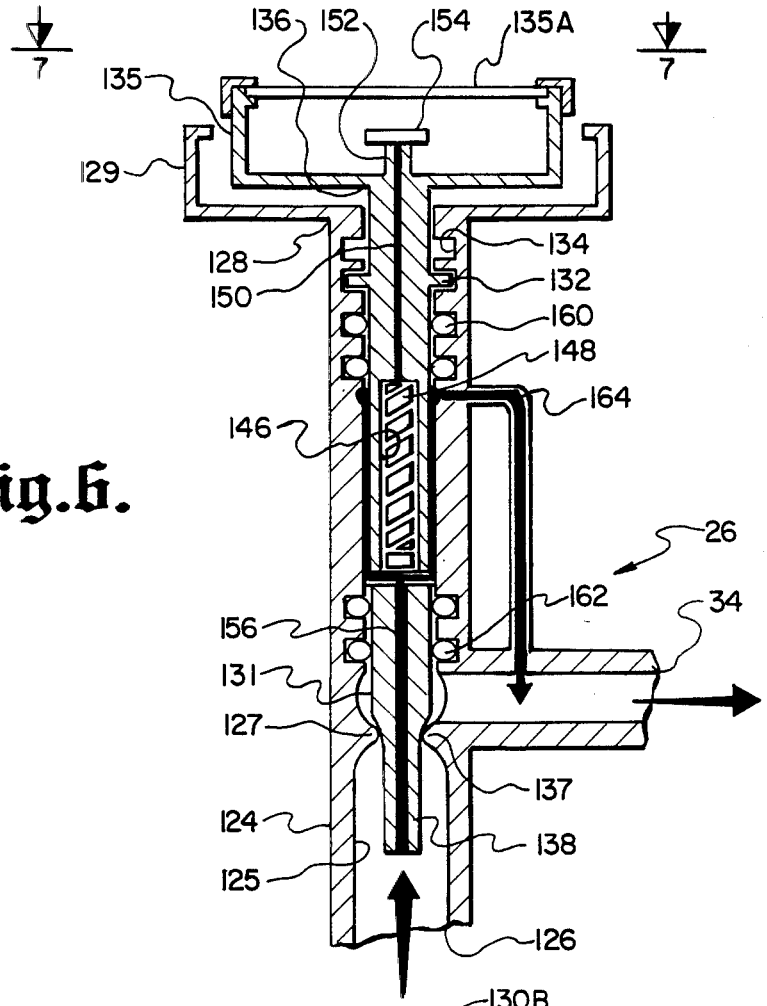

Illustrated in FIG. 6 is an enlarged cross-sectional view of the first valve means which controls the flow of Halon liquid as a function of temperature.

Figure 7:
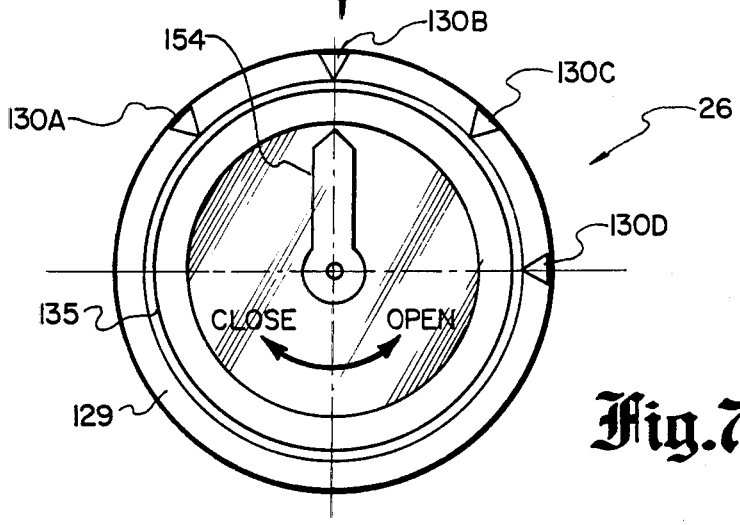

Illustrated in FIG. 7 is a top view of the first valve means shown in FIG. 6 along the line 7—7.

Figure 8:
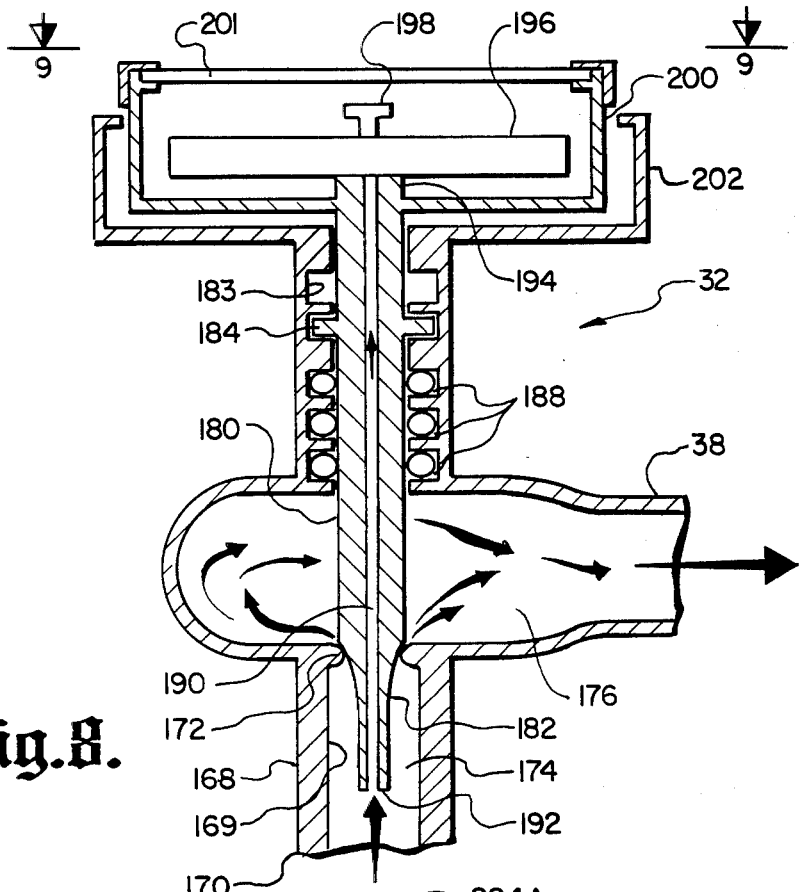

Illustrated in FIG. 8 is a cross-sectional view of the second valve means which controls the flow of Halon as a function of the Halon inlet pressure and at a selected flow rate and, further, is adapted to partially vaporize the Halon liquid into a vapor/liquid mixture.

Figure 9:
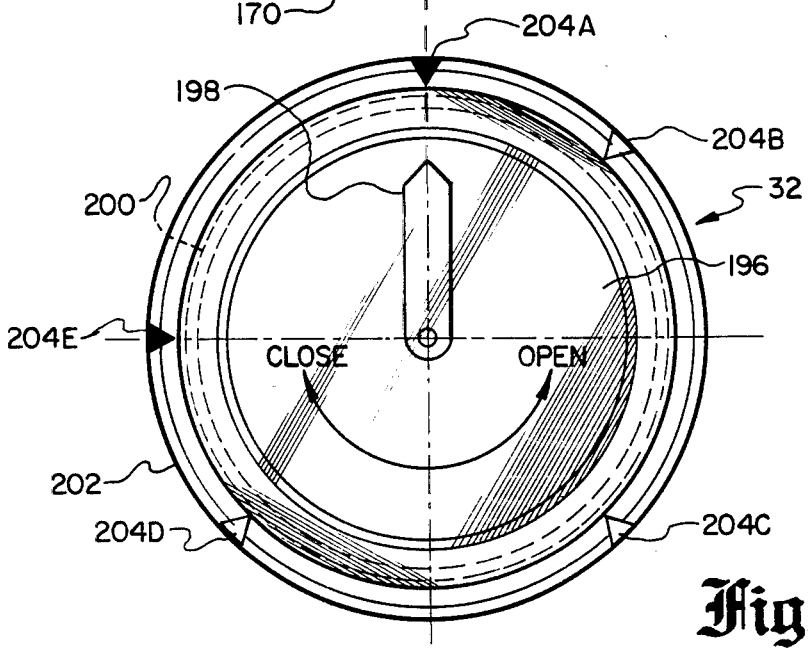

Illustrated in FIG. 9 is a top view of the second valve means shown in FIG. 8 along the line 9—9.

Illustrated in FIG. 10 is a cross-sectional view of a first preferred nozzle which is adapted to dispense the water/foam mixture having the individual bubbles of the foam filled with an air/Halon mixture.

Illustrated in FIG. 11 is a looking downward view of the nozzle shown in FIG. 10.

Illustrated in FIG. 12 is a cross-sectional view of the nozzle shown in FIG. 11 along the line 12—12.

Figure 13:
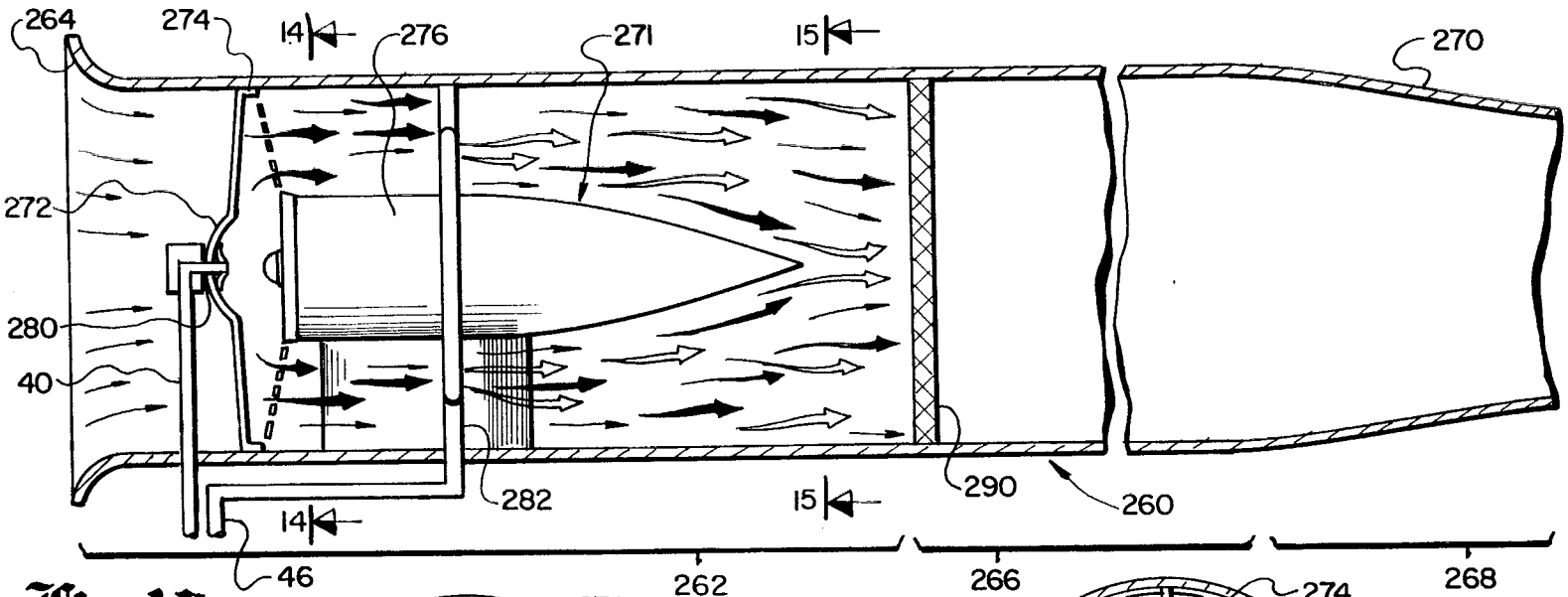

Illustrated in FIG. 13 is a cross-sectional view of a second embodiment of the nozzle.

Figure 14:
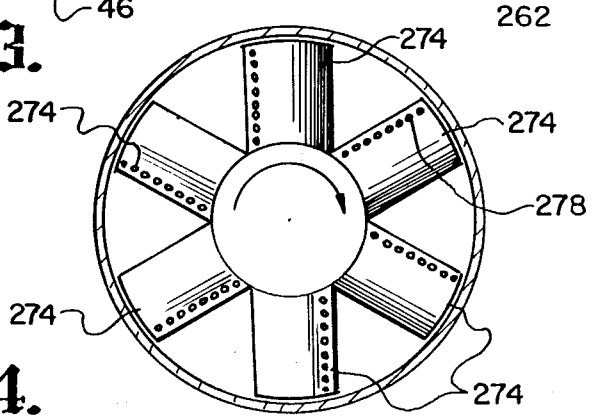

Illustrated in FIG. 14 is a cross-sectional view of the nozzle shown in FIG. 13 along the line 14—14.

Figure 15:
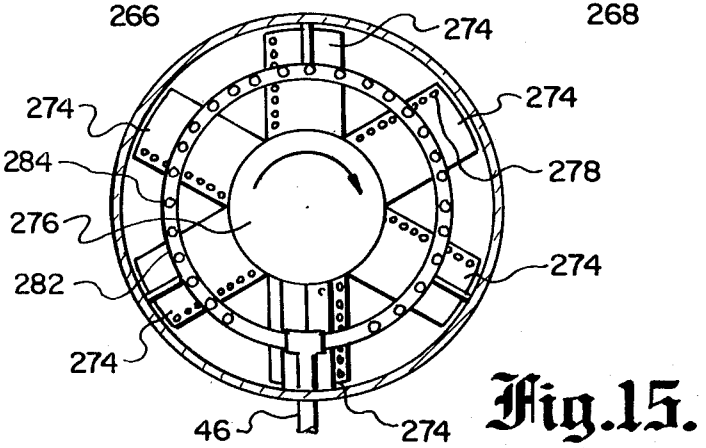

Illustrated in FIG. 15 is a cross-sectional view of the nozzle shown in FIG. 13 along the line 15—15.

BEST MODE FOR CARRYING OUT THE INVENTION

Figure 1:
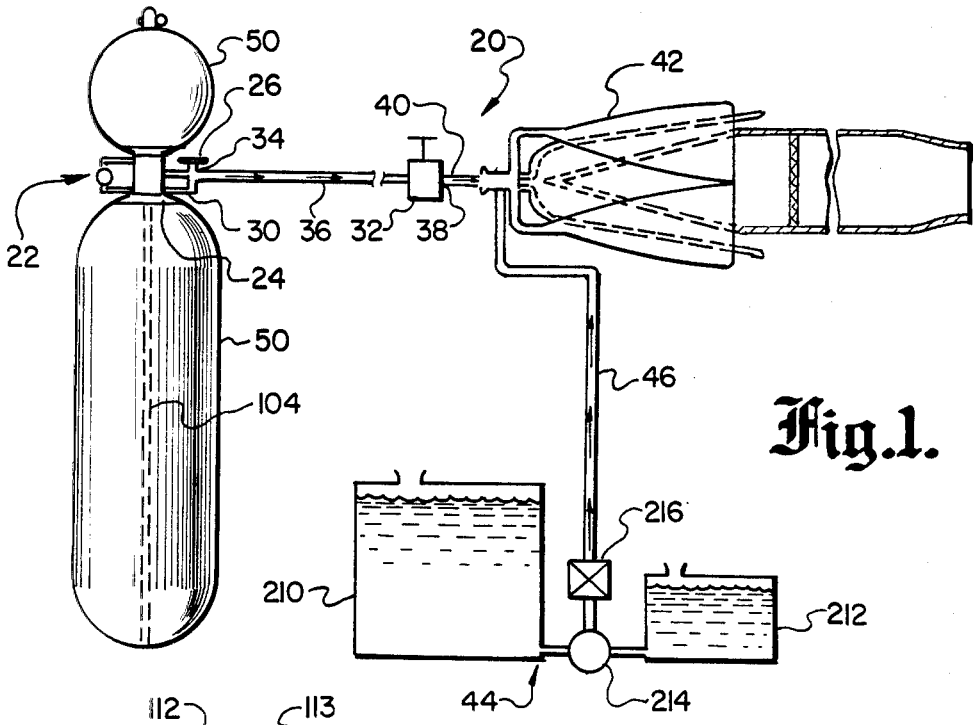

Referring to FIG. 1, it can be seen that the fire suppression system, generally indicated by numeral 20, includes a first dispensing means 22 adapted to deliver liquid Halon or other fire suppressant chemicals at a constant pressure to an outlet port 24. A first valve means 26, which is adapted to control the flow rate therethrough as a function of the inlet temperature of the Halon, is coupled via line 30, to the outlet port 24. A second valve means 32 is coupled to the outlet port 34 of the first valve means 26 via line 36. The second valve means 32 is adapted to control the flow rate of the Halon as a function of the Halon inlet pressure and selected flowrate and, furthermore, is adapted to partially vaporize the Halon. Coupled to an outlet port 38 of the second valve means 32, via line 40, is a nozzle assembly 42. Also coupled to the nozzle assembly 42, via line 46, is a second dispensing means 44 adapted to deliver a water/foaming agent mixture.

Still referring to FIG. 1 and, additionally, to FIGS. 4 and 5, it can be seen that the first dispensing means 22 comprises an inert gas tank 50, preferably, filled with nitrogen gas. The tank 50 includes an outlet port 52 which is hermetically sealed by a dome-shaped diaphragm 54. Mounted to the tank 50 is a frame member 56 supporting an explosive squib 58. The squib 58 is connected to an electrical circuit 59 which, in turn, is coupled to a firing circuit. Typically, the firing circuit is battery powered (neither shown). Mounted within the tank 50 is a support member 60 supporting a ram 62. Thus, when the squib 58 is fired, the explosive products will impact and break the diaphragm 54.

A third valve means 66 is mounted at one end to the tank 50 and, at its opposite end, to a Halon storage tank 68 (or other fire suppressant chemical). The valve means 66 includes a cylinder 70 having an internal chamber 71. A piston 72 is moveably mounted within the cylinder 70, dividing the chamber 71 into first and second portions 74A and 74B, respectively. The piston incorporates a groove 76 having a seal 78 mounted therein which seals the first and second portions 74A and 74B from each other. Coupling the two portions 74A and 74B together is a passage means in the form of a fluid line 80 having a pressure regulator 82 mounted thereto adapted to adjust the pressure of the nitrogen gas entering tank 50 to a specific operating value.

Mounted to the piston 72 are a pair of rams 86 and 87 extending into the second portion 74B. The rams 86 and 87 further extend into a pair of sealing members 90 and 91, respectively, mounted to the tank 68. The rams 86 and 87 are also aligned with a pair of pierceable diaphragms 94 and 95, respectively, sealing inlet and outlet ports 96 and 97, respectively, of the tank 68. Thus, the tank 68 is effectively hermetically sealed. Note that the fluid line 80 is coupled to the sealing member 90 and, thus, is in communication with the diaphragm 94. A removable safety pin 100 extends through the cylinder 70 and rams 86 and 87, locking both in place and preventing accidental actuation.

When the squib 58 is fired (after the removal of safety pin 100), the domed diaphragm 54 will be broken and nitrogen gas will flow through the fluid line 80 via regulator 82, and into sealing member 90. Simultaneously, as best illustrated in FIG. 5, the piston 72 will be moved downward towards the tank 68 by the gas pressure causing the rams 86 and 87 to pierce the diaphragms 94 and 95, respectively. The rupturing of diaphragm 94 allows the regulated nitrogen gas to flow into the inlet port 96 of the tank 68. Note that the cylinder 70 incorporates ports 101 which are provided to allow air to be vented from portion 74B as the piston 72 moves downward. The Halon, thereafter, pressurized by the nitrogen, will be forced out through the perforated diaphragm 95 and the outlet port 97 of the tank via riser tube 104 and out outlet port 24 at a constant pressure.

Referring now to FIG. 3, in order to assure that the holes made by the rams 86 and 87 in the diaphragms 94 and 95, respectively, have a precise cross-sectional area each ram has a generally crusiform-shaped body 106 and a tapered crusiform cutter 108 with a circular "peeler" ring 110 mounted therebetween. Thus, when the rams 86 and 87 contact the diaphragms 94 and 95, respectively, the crusiform cutters 108 pierce the diaphragms into four segments and, thereafter, the ring 110 ensures that the opening has a precise cross-sectional area. Thus, the flow area through the crusiform body 106, both in to and out of the tank 68, is precisely controlled and will not vary from system to system.

Figure 2:
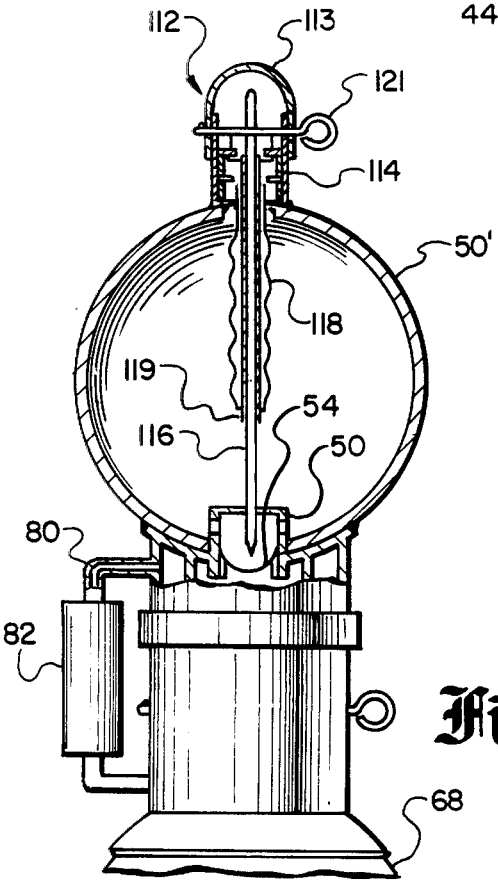

Referring to FIG. 2, it can be seen in this alternate configuration that it is possible and practical to puncture the diaphragm 54 by mechanical means. To this end, a ram assembly 112 with a safety cap 113 is provided. The ram assembly 112 includes a housing 114 mounted at the end opposite the diaphragm 54 of a nitrogen tank 50'. A ram 116 is moveably mounted therein. A bellows 118 is joined to the ram 116 at a first end 119 and, at its second end, to the housing 114. The ram 116 is held in the retracted position shown by means of a pin 121. Extracting the pin 121 will release safety cap 113. A moderate downward force applied to the top of ram 116 applied by hand will cause the ram 116 to pierce diaphragm 54 initiating nitrogen gas flow.

Still referring to FIG. 1 and, additionally, to FIGS. 6 and 7, it can be seen that the first valve means 26 is coupled to the outlet port 24 of the first dispensing means 22 via line 30. The first valve means 26 is necessary since the temperature, and therefore the density and viscosity of the Halon liquid, varies therewith. The first valve means 26 includes a body 124 having an internal chamber 125 coupling an inlet port 126 to the second outlet port 34. Mounted within the chamber 125 between the inlet port 126 and the outlet port 34 is a metering orifice 127. Mounted at the opposite end 128 of the body 124 is an open cup-shaped member 129 having inwardly facing index markers 130A, B, C, and D.

A hollow metering member 131 is rotatably mounted within the chamber 125 by means of dual external cam followers 132 on the member 131 which engage dual internal cam tracks 134 within the body 124. Rotation of the metering member 131 is accomplished by turning a cup-shaped knob 135, having a transparent cover 135A, mounted at a first end 136 thereof. Thus, the metering member 131, upon rotation, is translatable along the chamber 125. The metering member 131 at its second end 137 incorporates a metering pin 138 which extends through the metering orifice 127.

Mounted within a chamber 146 in the member 131 is a bi-metallic helical coil 148 coupled to a shaft 150 which extends into the center of the cup-shaped knob 135. The end 152 of the shaft 150 is coupled to a pointer 154. The bi-metallic helical coil 148 will tend to unwind (clockwise) as temperature increases from a nominal value and will further wind (counterclockwise) if the temperature drops below a nominal value.

The liquid Halon is ducted about the coil 148 by passage means 156 in the member 131 which connects the inlet port 126 to the chamber 125 between seal assemblies 160 and 162. A small tube 164 connects the section of the chamber 125 between the seal assemblies 160 and 162 to the outlet port 34. The tube 164 is quite small and meters only about two percent of the incoming Halon liquid to the outlet port 34. This flow of Halon liquid past the coil 148 ensures that the coil is "sensing" the true temperature of the incoming liquid Halon. Furthermore, the 2% Halon flow, when discharged from tube 164 into port 34, enters line 36 and precharges that line.

In most cases, the temperature of the liquid Halon will be at nominal value. Thus, pointer 154 will be in alignment with index mark 130B on the circular gauge member 129 ("N" stands for "normal"). If the liquid Halon should be hotter or colder than nominal, the pointer 154 will rotate clockwise or counterclockwise (because of the coil 148 unwinding or winding) toward index markers 130A or 130C. To open the valve and initiate proper flow, the operator need only rotate the knob 135 counterclockwise so that the pointer 154 is aligned with the index mark 130D. This will place the metering pin 138 in the proper relationship to the metering orifice 127, thus, adjusting the flow rate for variations in the temperature of the incoming Halon liquid.

While the first valve means 26 is shown and described as "manually operated", primarily for reliability purposes and to reduce costs, it should be understood that an automatic valve (regulator) could be substituted.

Still referring to FIG. 1 and, additionally, to FIGS. 8 and 9, it can be seen that the second valve means 32 includes a body 168 having an internal chamber 169 connecting an inlet port 170 (coupled to the second outlet port 34, via line 36) to the third outlet port 38. Mounted within the chamber 169 is a metering orifice 172 dividing the chamber 169 into first and second portions 174 and 176, respectively. The second portion 176 is in the form of a flat doughnut-shaped cavity.

Rotatably mounted within the chamber 169 of the body 168 is a metering member 180 having a metering rod 182 extending through the metering orifice 172. Rotation of the metering member 180 is accomplished by means of internal dual cam tracks 183 mounted in the body 168 and external dual cam followers 184 on the metering member 180. The second portion 176 of the chamber 169 is sealed by a plurality of seal assemblies 188. The metering member 180 includes a passage 190 extending from a first end 192 (the end of the metering rod 182) to a second end 194 and, thereafter, couples to a bourdon tube 196 mounted to second end 194. The bourdon tube 196 is connected to a pointer 198. Also mounted on the second end 194 is a circular cup-shaped knob 200, having a transparent cover 201, in which the bourdon tube 196 and pointer 198 are mounted therein. Attached to the body 168 is a cup-shaped circular gauge member 202 extending about the knob 200 and which incorporates a plurality of index markers 204A, 204B, 204C, 204D, and 204E.

Assuming that the first dispensing means 22 has been activated and the temperature compensated for by the first valve means 26, the operation of the second valve means is as follows. When the liquid Halon enters the inlet port 170, it travels up the passage 190 to the bourdon tube 196. The delivery pressure is indicated by the pointer 198 moving counterclockwise. The valve is opened by rotating the knob 200 counterclockwise until the pointer 198 is aligned with the desired index flow rate marker. This will adjust the position of the metering rod 182 in relationship to the metering orifice 172 which sets the flow rate into the second portion 176 of the chamber 169 as a function of inlet pressure and the selected index marker. From portion 174 to portion 176, the flow area expands significantly, causing the liquid Halon to partially vaporize and resulting in mixed phase flow (a first mixture) to the third outlet port 38. Thus, the second valve means 32 automatically compensates for line losses; since in some applications where the first dispensing means 22 and first valve means 26 may be located some distance from the nozzle assembly 42. Thus, a considerable fluid pressure loss can be experienced in the line 36. Additionally, the valve means 32 will set Halon delivery flow to the desired concentration level; that is 204D is 5%, 204C is 10% and 204B is 15% concentration.

Referring particularly to FIG. 1, the second dispensing means 44 comprises a water tank 210 and a foaming agent tank 212, both coupled to a proportioning pump 214. The pump 214 proportions the water-to-foaming agent to a proper ratio and pressure level, forming a second mixture. The second mixture passes to the nozzle assembly 42, via line 46, which incorporates a shut-off valve 216. The shut-off valve 216 ensures that, when the system 20 is stored, the foaming agent and water are sealed from the nozzle assembly 42 and, therefore, ambient atmospheric conditions. The pump 214 is preferably battery powered by the same battery (not shown) used to ignite the squib 58. An alternate system (not shown) using pressurized water and forming agent tanks and a pressure regulator instead of a pump would also function adequately as a second dispensing means.

Still referring to FIG. 1 and, in addition, FIGS. 10, 11, and 12, it can be seen that a first embodiment of the nozzle assembly 42, comprises essentially a double venturi system which includes a generally conical-shaped first portion 220, a tubular, middle portion 222, including a foam-breaker screen 223 mounted therein, and an end portion in the form of a converging nozzle 224.

Referring particularly to the first portion 220, it can be seen that it includes a hollow, inner-conical shaped member 236 having an inlet port 238 at its apex 240 which is coupled to line 46. In close proximity to the apex 240 are a plurality of first apertures 242 (only one is indicated). A second hollow, conical-shaped member 244 is mounted about member 236 and includes a blunted apex 246 and an end 248 open to ambient air. A plurality of second apertures 250 (only one is indicated) are located about the circumferance of the member 244 in proximity to the end 248. Mounted about a portion of the member 244 are two Halon expansion chambers 252A and 252B (there could be more) which cover the second apertures 250. The line 40 is coupled via lines 254A and 254B, to the expansion chambers 252A and 252B.

With the squib iginited, the first and second valve means 26 and 32, properly adjusted, and the dispensing means 44 operating, mixed phase Halon (mixture 1) enters expansion chambers 252A and 252B via the lines 254A and 254B. The expansion chambers 252A and 252B are designed to completely vaporize the remaining liquid Halon and, further, to expand the vaporized Halon to prevailing ambient pressure. Simultaneously, the water/foaming agent (mixture two) enters the conical member 236 via inlet port 238. The high velocity of the second mixture causes a pressure drop at first apertures 242, causing air to be "drawn" up between members 236 and 244. With ambient air flowing between members 236 and 244, a pressure drop will occur at the second apertures 250 drawing the vaporized and expanded Halon therethrough into the area between members 236 and 244 where it is mixed with the air forming a third mixture. Thereafter, the third mixture is "drawn" into the interior of member 236 via first apertures 242 where turbulent mixing of the second and third mixtures takes place. The composite of the second and third mixtures flows into the second portion 222 and impacts on the screen 223 where foam bubbles are produced in which a Halon vapor and air mixture (mixture three) is encapsulated. Thereafter, the foam exits the nozzle 224.

Again referring to FIGS. 13, 14 and 15, it can be seen that a second embodiment of the nozzle assembly, designated generally by numeral 42A, includes a hollow, tubular member 260 including a first portion 262, having a first end terminating in a bell-mouth opening 264, a middle portion in the form of a foam-refining chamber 266, and a second end 268 terminating in a converging nozzle 270. Mounted in the first portion 262 is a fan assembly 271 which includes a hollow hub 272, a plurality of hollow fan blades 274 joined to the hub 272 are powered by an electric motor 276. The hollow blades 274 on the trailing edge incorporate a plurality of apertures 278 (only one of which is indicated). The line 40 is connected to an inlet port 280 which connects to the hub 272. A rotary seal assembly (not shown) is used to seal the inlet port 280 to the hub 272.

Mounted downstream of the blades 274 is a foam-dispensing ring 282 connected to line 46. The dispensing ring 282 incorporates a plurality of apertures 284 (only one of which is indicated), which face toward the screen 290. When the system is in operation as previously discussed, the first mixture (mixed phase Halon) enters the hollow hub 272 and blades 274 wherein the remaining liquid Halon is completely vaporized and expanded to prevailing ambient pressure. The rotating fan blades draw in air through the inlet 264 and force the air into the first portion 262, "drawing" the vaporized Halon out of the blades 274 and causing the vaporized Halon to mix with the air forming a third mixture. Thereafter, the foam exiting the ring 282, via apertures 284, at high speed, further "draws" the third mixture down the portion 262 where turbulent mixing with the foam solution takes place and, upon impact with the foam-breaker screen 290 in portion 266, foam is produced, consisting of a large number of small-sized bubbles into each of which the third mixture is encapsulated. Thereafter, the "finished foam" will exit nozzle 270 at an increased velocity due to the nozzle's reduction in cross-sectional area.

While the invention has been described with reference to particular embodiments, it should be understood that the embodiments are merely illustrative as there are numerous variations and modifications which may be made by those skilled in the art. Thus, the invention is to be construed as being limited only by the spirit and scope of the appended claims.

Industrial Applicability

This invention has application for fire suppression and, in particular, for fire suppression in areas where people are normally present. Furthermore, the invention applies to all areas where fire suppression by foam is presently in use such as: aircraft hangars, ship holds, oil drilling rigs, etc.

I claim:

1. A fire suppression system comprising:

first dispensing means adapted to provide a flow of liquid fire suppressant chemical at a constant pressure to a first outlet port;

first valve means coupled to said first outlet port adapted to control the flow of said liquid chemical to a second outlet port as a function of the inlet temperature thereof;

second valve means coupled to said second outlet port of said first valve means adapted to meter said liquid chemical as a function of the inlet pressure level thereof and selected flow rate of same and to cause said liquid chemical to partially vaporize forming a liquid/vapor phase first mixture and provide said first mixture to a third outlet port coupled thereto;

second dispensing means adapted to provide a second mixture of water and foam-generating agent at a constant pressure; and nozzle means coupled to said second dispensing means, said third output port of said second valve means and to a source of ambient air, said nozzle means adapted to fully vaporize said first mixture and expand said vaporized chemical to ambient pressure and thereafter combine it with ambient air forming a third mixture and to further combine said third mixture with said second mixture and by encapsulation forming a foam wherein said bubbles of said foam contain said third mixture.

2. The system as set forth in claim 1 wherein said first dispensing means comprises:

a first tank adapted to contain an inert pressurized gas, said first tank having an outlet port;

a second tank adapted to contain said fire suppressant chemical, said second tank including an outlet port and an inlet port;

passage means coupling said first tank to said second tank;

regulator means mounted in said passage means adapted to control the pressure level in said second tank to a constant valve; and third valve means adapted when actuated to direct pressurized inert gas from said first tank to said second tank via said passage means and said fire suppresant chemical from said outlet port of said second tank to said first outlet port.

3. The system as set forth in claim 2 wherein:

said first tank is filled with said inert gas and hermetically sealed, said first tank including a first pierceable diaphragm sealing off said inert gas from said passage means; and said second tank is filled with said fire suppressant chemical in a liquid state and hermetically sealed, said second tank including second and third pierceable diaphragms, said second diaphragm sealing off said inlet port from said passage means, and said third diaphragm sealing off said outlet port of said second tank.

4. The system as set forth in claim 3 wherein said third valve means comprises:

a cylinder having a piston moveably mounted therein dividing said cylinder into first and second portions, said first portion of said cylinder in communication with said outlet port of said first tank and said passage means;

first and second rams mounted to said piston extending into said second portion of said cylinder and in alignment with said second and third diaphragms, respectively;

sealing means sealing said second portion of said cylinder from said second and third diaphragms; and an explosive squib mounted in said first portion of said cylinder adapted when actuated to break said first diaphragm;

such that upon actuation of said squib said first diaphragm is broken allowing said inert gas to flow into said passage means and through said regulator means, which adjusts the pressure to a desired level and, thereafter, to said inlet port of said second tank, while, simultaneously said inert gas forces said piston toward said second and third diaphragms causing said rams to pierce said second and third diaphragms allowing said inert gas to pressurize said second tank forcing said liquid fire suppressant chemical out of said first outlet port.

5. The system as set forth in claim 4 wherein said first and second rams have conical-shaped cruciform cutters and substantially constant diameter cruciform-shaped bodies with circular peeler rings mounted therebetween; such that when said first and second rams pierce said second and third diaphragms said peeler rings insures a constant-sized hole through said second and third diaphragms and said cruciform bodies ensure a uniform flow area therethrough.

6. The system as set forth in claim 5 wherein said inert gas is nitrogen and said chemical is a Halon compound.

7. The system as set forth in claim 6 wherein said second dispensing means comprises:

a third tank adapted to be filled with water;

a fourth tank adapted to be filled with a foaming agent;

proportional pump means coupled to said third and forth tanks adapted to provide a second mixture of water and foaming agent in a fixed volume ratio to said nozzle; and a shut-off valve coupled to said proportional pump means adapted to control the flow of said second mixture to said nozzle means.

8. The system as set forth in claim 1 wherein said first valve means comprises:

a body having a chamber therein, said body having an inlet port coupled to said first outlet port, and said second outlet port, said inlet port and said second outlet port in communication with said chamber;

a metering orifice having a tapered aperture therethrough mounted within said chamber dividing said chamber into first and second portions, said first portion in communication with said inlet port and said second portion in communication with said second outlet port;

a metering member, having first and second ends, rotatably engaging said body terminating at said first end in a tapered metering pin extending at least partially into said aperture, said tapered metering pin moveable in relationship to said aperture upon rotation of said metering member, said metering member further having a cavity extending from said second end into said second portion of said chamber;

a rod rotatably mounted within said metering member having a first end terminating in a bi-metallic helical coil joined to said metering member, said coil extending into said second chamber and a second end extending out of said metering member terminating in a pointer, said helical coil adapted to wind or unwind depending upon an up or down temperature shift, respectively, of said liquid fire suppressant chemical in said first portion causing said pointer to rotate clockwise or counterclockwise, respectively; and a hollow gauge member mounted to said second end of said metering member having a set of flow index markers indicating the temperature status of said liquid fire suppressant chemical;

such that as said liquid chemical flows through said first portion of said chamber a change in temperature of said liquid chemical therein will cause said first pointer to rotate, and the flow to said second outlet port can be temperature compensated for by rotation of said hollow gauge member aligning said first pointer with said flow index marker.

9. The system as set forth in claim 8 further including;

the portion of said chamber about said helical coil sealed at either end from the remaining portions of said chamber;

said metering rod incorporating a flow passage coupling, said first end of said metering member to said sealed portion of said chamber; and a tubular by-pass line coupling said sealed portion of said chamber to said second outlet port;

such that a portion of said liquid chemical may flow from said inlet port to said second outlet port, via said sealed off portion of said chamber insuring that the helical coil will accurately senses the temperature of said incoming liquid chemical, and said portion of said liquid chemical flowing into said second outlet port will precharge said line coupling said first and second valve means.

10. The system as set forth in claim 1 wherein said second valve means comprises:

a body having an inlet port coupled to said second outlet port and, further, to said third outlet port; said body having a chamber therein coupling said inlet port to said third outlet port;

a metering orifice having a tapered aperture therethrough dividing said chamber into first and second portions, said first portion in communication with said inlet port and said second portion in communication with said third outlet port, said second portion being of sufficient size as to allow for partial vaporization of said liquid chemical flowing therein from said first portion;

a metering member rotatably mounted within said body having a passage extending from its first end to its second end, said metering member having a tapered metering pin at said first end extending through said tapered aperture, said tapered metering pin moveable in relationship to said aperture upon rotation of said metering member vary the flow rate of said liquid chemical from said first portion to said second portion of said chamber, said movement of said metering pin limited in relationship to said metering orifice such that said liquid chemical is partially vaporized in said second portion forming a first mixture comprising vapor phase and liquid chemical;

a bourdon tube mounted on said second end of said metering member coupled to said passage, said bourdon tube terminating in a first pointer such that said pointer rotates as a function of the pressure of said liquid chemical in said first portion of said chamber; and an index gauge member mounted to said body having a plurality of flow rate index markers;

such that said liquid chemical flowing into said first portion will cause said bourdon tube to wind or unwind depending upon said pressure, such that, by rotating said metering member counterclockwise, said pointer can be aligned with any one of said flow rate index markers.

11. The system as set forth in claim 1 wherein said nozzle assembly comprises:

a conical-shaped first member having an inlet port at the apex thereof coupled to said second dispensing means, and a plurality of first apertures in close proximity to said apex;

a conical-shaped second member mounted about said first member having a closed-off first end and a second end open to ambient air said second member forming an annular conical-shaped chamber about said first member, said second member having a plurality of second apertures in close proximity to said second end of said second member;

at least one expansion chamber mounted about said second member sealing off said plurality of second apertures, said expansion chamber coupled to said third outlet port and adapted to expand said first mixture so that said first mixture is completely vaporized and is expanded to ambient pressure;

a substantually constant diameter foam refinement chamber having first and second ends, said first end coupled to the end opposite said apex of said first member, said refinement chamber including a foam producing screen; and a converging exit nozzle coupled to the second end of said refinement chamber;

such that when said second mixture flows into said conical-shaped first member ambient air is drawn in between said first and second members, said vaporized and expanded first mixture air, in turn, is drawn through said second apertures forming a third mixture and said third mixture is drawn through said first apertures wherein a foam is formed by encapsulation of said third mixture within the bubbles of said foam by said screen.

12. The system as set forth in claim 1 wherein said nozzle assembly comprises:

a first hollow tubular member having first and second ends, said first end open to ambient air;

a second hollow tubular member having first and second ends, said first end coupled to said second of said first member;

a discharge nozzle having a first end coupled to said second end of said second member and a second end terminating in a converging nozzle;

a foam generating screen mounted within said second member adapted to generate uniform foam bubbles;

a fan mounted within said first member comprising:

a motor;

a hollow hub rotatably mounted to said motor, said hub coupled to said third outlet port;

a plurality of hollow blades coupled to said hub, said blades having a plurality of first apertures facing said second end of said first member;

a water/foaming agent spray ring coupled to said second dispensing means having a plurality of second apertures facing said second end of said first member;

such that when said first mixture flows from said second valve means into said hollow hub and said hollow blades it is converted into a vapor and is expanded to ambient pressure and said rotating fan draws in said ambient air through said open first end and propels it past said hub and fan blades drawing said vaporized chemical out of said blades mixing said vaporized chemical with said air forming a third mixture and, thereafter, combines with said second mixture exiting said spray ring wherein said screen, by encapsulation, produces said foam in which each of said bubbles is filled with said third mixture and, thereafter, said foam is expelled through said discharge nozzle.

* * * * *

UNITED STATES PATENT AND TRADEMARK OFFICE

CERTIFICATE OF CORRECTION

PATENT NO. : 4,531,588

DATED : July 30, 1985

INVENTOR(S) : Wilhelm A. Bruensicke

It is certified that error appears in the above-identified patent and that said Letters Patent is hereby corrected as shown below:

On the title page inventor should read

-- Wilhelm A. Bruensicke --.

Signed and Sealed this

*Tenth* Day of *June 1986*

[SEAL]

*Attest:*

DONALD J. QUIGG

*Attesting Officer*

*Commissioner of Patents and Trademarks*